US010746371B2

(12) United States Patent
Matsumoto et al.

(10) Patent No.: US 10,746,371 B2
(45) Date of Patent: Aug. 18, 2020

(54) VEHICULAR LAMP

(71) Applicant: STANLEY ELECTRIC CO., LTD., Tokyo (JP)

(72) Inventors: Naoko Matsumoto, Tokyo (JP); Hiroaki Yamamoto, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/443,363

(22) Filed: Jun. 17, 2019

(65) Prior Publication Data

US 2019/0383458 A1 Dec. 19, 2019

(30) Foreign Application Priority Data

Jun. 18, 2018 (JP) ..... 2018-115398

(51) Int. Cl.

| | |
|---|---|
| ***F21S 41/64*** | (2018.01) |
| ***F21V 29/67*** | (2015.01) |
| ***F21S 45/49*** | (2018.01) |
| ***F21S 41/143*** | (2018.01) |
| ***F21S 45/42*** | (2018.01) |

(52) U.S. Cl.

CPC ..... *F21S 41/645* (2018.01); *F21S 41/143* (2018.01); *F21S 45/42* (2018.01); *F21S 45/49* (2018.01); *F21V 29/67* (2015.01)

(58) Field of Classification Search

CPC ..... F21V 29/677; F21S 41/645; F21S 45/42; F21S 45/49

See application file for complete search history.

(56) References Cited

U.S. PATENT DOCUMENTS

| | | | | |
|---|---|---|---|---|
| 8,439,537 | B2 * | 5/2013 | Nakazato | F21S 41/14 362/510 |
| 8,702,258 | B2 * | 4/2014 | Toko | F21V 5/002 362/84 |
| 2002/0015305 | A1 * | 2/2002 | Bornhorst | F21S 10/007 362/293 |
| 2013/0250381 | A1 * | 9/2013 | Toko | G02B 5/32 359/19 |
| 2014/0218950 | A1 * | 8/2014 | Kim | F21S 45/60 362/509 |
| 2017/0160542 | A1 | 6/2017 | Mouri et al. | |

(Continued)

FOREIGN PATENT DOCUMENTS

| | | |
|---|---|---|
| DE | 10 2014 113 387 A1 | 3/2016 |
| FR | 3 058 503 A1 | 5/2018 |

(Continued)

OTHER PUBLICATIONS

The extended European Search Report for the related European Patent Application No. 19180675.1 dated Oct. 28, 2019.

*Primary Examiner* — Alexander K Garlen
(74) *Attorney, Agent, or Firm* — Kenealy Vaidya LLP

(57) ABSTRACT

A vehicular lamp having a novel structure includes: a light source configured to emit light from a semiconductor light-emitting element along an optical path; a light distribution control device disposed on the optical path of the light emitted from the light source; and a blower fan configured to generate an airflow while the light source and the light distribution control device are disposed downwind of the blower fan, and blow air to the light source and the light distribution control device.

16 Claims, 5 Drawing Sheets

(56) References Cited

U.S. PATENT DOCUMENTS

| | | | | |
|---|---|---|---|---|
| 2017/0276980 | A1* | 9/2017 | Kauschke | F21S 41/135 |
| 2017/0328535 | A1* | 11/2017 | Yagi | F21V 29/504 |

FOREIGN PATENT DOCUMENTS

| | | | | | |
|---|---|---|---|---|---|
| JP | H06-191346 | A | | 7/1994 | |
| JP | 08179319 | A | * | 7/1996 | F21S 45/10 |
| JP | 2014-56792 | A | | 3/2014 | |
| WO | 2017/132713 | A1 | | 8/2017 | |
| WO | 2018/177979 | A1 | | 10/2018 | |
| WO | 2018/225655 | A1 | | 12/2018 | |

* cited by examiner

VEHICULAR LAMP

This application claims the priority benefit under 35 U.S.C. § 119 of Japanese Patent Application No. 2018-115398 filed on Jun. 18, 2018, which is hereby incorporated in its entirety by reference.

TECHNICAL FIELD

The presently disclosed subject matter relates to a vehicular lamp including a semiconductor light-emitting element and a liquid crystal element.

BACKGROUND ART

Common vehicles such as automobiles are equipped with a lighting device (headlamp, headlight, etc.) configured to brighten the surroundings (in particular, areas in the forward direction in which a vehicle travels). Vehicle headlamps mainly include a light source configured to emit white light, a projection optical system configured to magnify light emitted from the light source and project the same, and a housing configured to support these components.

In recent years, in the technical field of vehicular headlamps, attention has been paid to a technique for controlling a light distribution pattern in real time in accordance with a situation in front, that is, presence or absence of an oncoming vehicle, a preceding vehicle, and a position thereof. Such a technique is known as an adaptive driving beam (ADB) system. In addition, headlamp systems (called AFS, adaptive front-lighting system, etc.) configured to adjust a light distribution in the traveling direction in accordance with the steering angle of the steering wheel are becoming popular. Liquid crystal elements can be adopted as a light distribution control element for ADB and AFS (see, for example, Japanese Patent Application Laid-Open No. Hei. 06-191346).

Note that when a semiconductor light-emitting element (LED element) is used as the light source, the light source usually generates heat and becomes high temperature. In such a case, it is preferable to provide a blower fan configured to cool the light source (see, for example, Japanese Patent Application Laid-Open No. 2014-056792).

SUMMARY

The presently disclosed subject matter was devised in view of these and other problems and features in association with the conventional art. According to an aspect of the presently disclosed subject matter, there can be provided a vehicular lamp having a novel structure. According to another aspect of the presently disclosed subject matter, there can be provided a vehicular lamp capable of optimizing the temperature of the entire system.

According to further another aspect of the presently disclosed subject matter, there can be provided a vehicular lamp comprising: a light source configured to emit light along an optical path; a light distribution control device disposed on the optical path of the light emitted from the light source; and a blower fan configured to generate an airflow while the light source and the light distribution control device are disposed downwind of the blower fan, and blow air to the light source and the light distribution control device.

In the vehicular lamp according to the aforementioned aspect, the light distribution control device may include a liquid crystal element disposed on the optical path of the light emitted from the light source, a pair of polarizing plates sandwiching the liquid crystal element on the optical path; and a housing configured to support the liquid crystal element and the pair of polarizing plates and having a high thermal conductivity to dissipate heat generated by the liquid crystal element and the pair of polarizing plates.

The vehicular lamp according to any of the aforementioned aspects may further include a heat transfer control mechanism configured to control thermal connection with the light source and the light distribution control device to control conduction of heat generated by the light source to the light distribution control device. In this case, the heat transfer control mechanism may be disposed between the blower fan and the light distribution control device and also configured to shield an airflow from the blower fan to the light distribution control device.

Furthermore, in the vehicular lamp according to any of the aforementioned aspects, the light source may include a semiconductor light-emitting element, and a heat sink configured to efficiently dissipate heat generated by the semiconductor light-emitting element and have a base portion having a plate shape provided with a through hole. In this case, the vehicular lamp may further include an airflow control mechanism that is disposed to be capable of closing the through hole provided to the base portion of the heat sink and configured to shield an airflow to be passed through the through hole.

Furthermore, in the vehicular lamp according to any one of the aforementioned aspects, the blower fan may be configured to generate an airflow while the light source and the light distribution control device are disposed upwind of the blower fan to cause the air warmed by heat generated by the light source to move in a direction away from the light source and the light distribution control device.

According to the vehicular lamp, it is possible to efficiently control the temperature of the entire vehicular lamp.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to vehicular lamps of the presently disclosed subject matter with reference to the accompanying drawings in accordance with exemplary embodiments.

Figure 1:
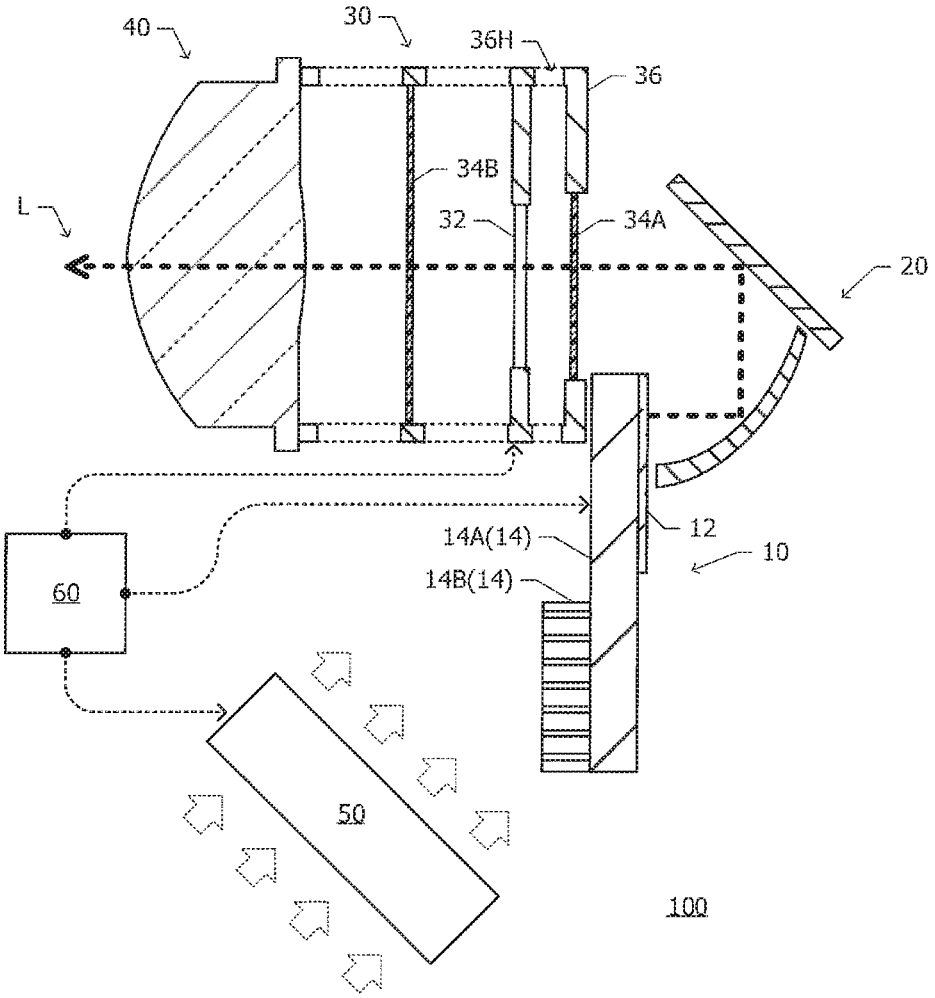
FIG. 1 is a cross-sectional view showing a basic form of a vehicular lamp made in accordance with principles of the presently disclosed subject matter as an exemplary embodiment.

FIG. 1 is a cross-sectional view showing a basic structure of a vehicular lamp 100 according to an embodiment as a headlight. The headlight 100 mainly includes: a light source 10 including a semiconductor light-emitting element (LED element) configured to emit white light L (indicated by a broken line arrow in the drawing); a reflection mirror 20 configured to reflect the white light L emitted from the light source 10; a light distribution control device 30 configured to control light distribution of the white light L having been reflected by the reflection mirror 20 (e.g., configured to select a light transmission region and a non-transmission region); a projection lens 40 configured to magnify and project the white light L that has passed through the light distribution control device 30; and a blower fan 50 configured to cool both the light source 10 and the light distribution control device 30 which can become high temperature. These components may usually be disposed in a lamp chamber defined by a housing in the form of a container and a cover lens in the form of a lid.

The light source 10 includes an LED circuit board (or LED) 12 on which LED elements are mounted, and a heat radiating member (heat sink) 14 configured to efficiently dissipate heat generated by the circuit board 12 (in particular, the LED elements). The LED element may include, for example, a GaN-based semiconductor that emits blue light, and a YAG phosphor that absorbs blue light and emits yellow light as a result of excitation so as to emit synthesized white light. The heat sink 14 has a base portion 14A which is in close contact with the circuit board 12 and has excellent thermal conductivity, and a fin portion 14B which efficiently releases heat.

The light distribution control device 30 mainly includes a liquid crystal element 32 capable of converting a polarization direction of light, a pair of polarizing plates 34 sandwiching the liquid crystal element 32 (an input side polarizing plate 34A and an output side polarizing plate 34B), and a housing 36 formed of a member supporting these components and having a high thermal conductivity. Examples of the liquid crystal element 32 and the pair of polarizing plates 34 may include those generally known as these components, and those disclosed in Japanese Patent Application Laid-Open No. Hei. 06-191346. The housing 36 is provided with a ventilation hole (or ventilation groove) 36H configured to improve ventilation.

The blower fan 50 blows air mainly to the light source 10 (in particular, the fin portion 14B) and the light distribution control device 30 (in particular, in the vicinity of the liquid crystal element 32 and the input-side polarizing plate 34A) to cool them. Examples of the blower fan 50 used may include generally known blower fans such as an axial flow fan and a centrifugal fan.

As the reflection mirror 20 and the projection lens 40, those generally used in vehicular lamps may be used. These structures and configurations are not particularly limited.

The headlight 100 is further provided with a control device 60 configured to mainly control the light source 10 (LED element), the light distribution control device 30 (in particular, the liquid crystal element 32), and the blower fan 50. The control device 60 controls the driving of the LED element in the light source 10 (ON/OFF of light emission) and the driving of the liquid crystal element 32 (selecting a light transmitting region and a light non-transmitting region as the light distribution control device 30). In addition, the control device 60 controls the driving of the blower fan 50 or the number of revolutions (air volume).

In a headlight for a vehicle, relatively large electric power is input to an LED element in order to increase the intensity of the output light. Therefore, the LED element can generate heat to become a high temperature. From the viewpoint of ensuring the performance, long-term reliability, and the like of the peripheral members of the LED element or the LED element itself, it is desirable that the LED element serving as the heat source or the light source including the LED element be effectively cooled.

The input-side polarizing plate 34A of the light distribution control device 30 transmits only light having a predetermined (first direction) polarization component among the incident white light, and shields light having other (second direction orthogonal to the first direction) polarization components. The energy of the light to be shielded is generally converted to thermal energy, wherein at least 50% or more of the incident light is converted to thermal energy.

When the intensity of the light emitted from the LED element (light incident on the input-side polarizing plate 34A) is relatively large, the thermal energy converted in the input-side polarizing plate 34A is also large. Therefore, the input-side polarizing plate 34A may generate heat to become a high temperature. From the viewpoints of ensuring the performance, long-term reliability, and the like of the liquid crystal element 32 disposed in the vicinity of the input-side polarizing plate 34A or the input-side polarizing plate 34A itself, it is particularly desirable that the liquid crystal element 32 and the input-side polarizing plate 34A be effectively cooled.

The air sent from the blower fan 50 hits the heat sink 14, in particular, the fin portion 14B, thereby effectively cooling the light source 10 (LED element). Further, the air sent from the blower fan 50 passes through the ventilation hole 36H of the housing 36 and directly hits the liquid crystal element 32 and the pair of polarizing plates 34, whereby the liquid crystal element 32 and the pair of polarizing plates 34 are effectively cooled. Further, since the housing 36 itself is also cooled by the air sent from the blower fan 50, the liquid crystal element 32 and the pair of polarizing plates 34 that are thermally connected thereto are also indirectly cooled.

The housing 36 is preferably formed from a metal member such as an aluminum alloy or a magnesium alloy which is excellent in thermal conductivity and heat dissipation. Alternatively, a thermally conductive resin member can be used.

It is known that the response speed of the liquid crystal element 32 used in the light distribution control device 30 decreases at a low temperature. Therefore, when the headlight 100 is used in a low temperature environment, it is better to heat the light distribution control device 30, in particular, the liquid crystal element 32.

Figure 2:
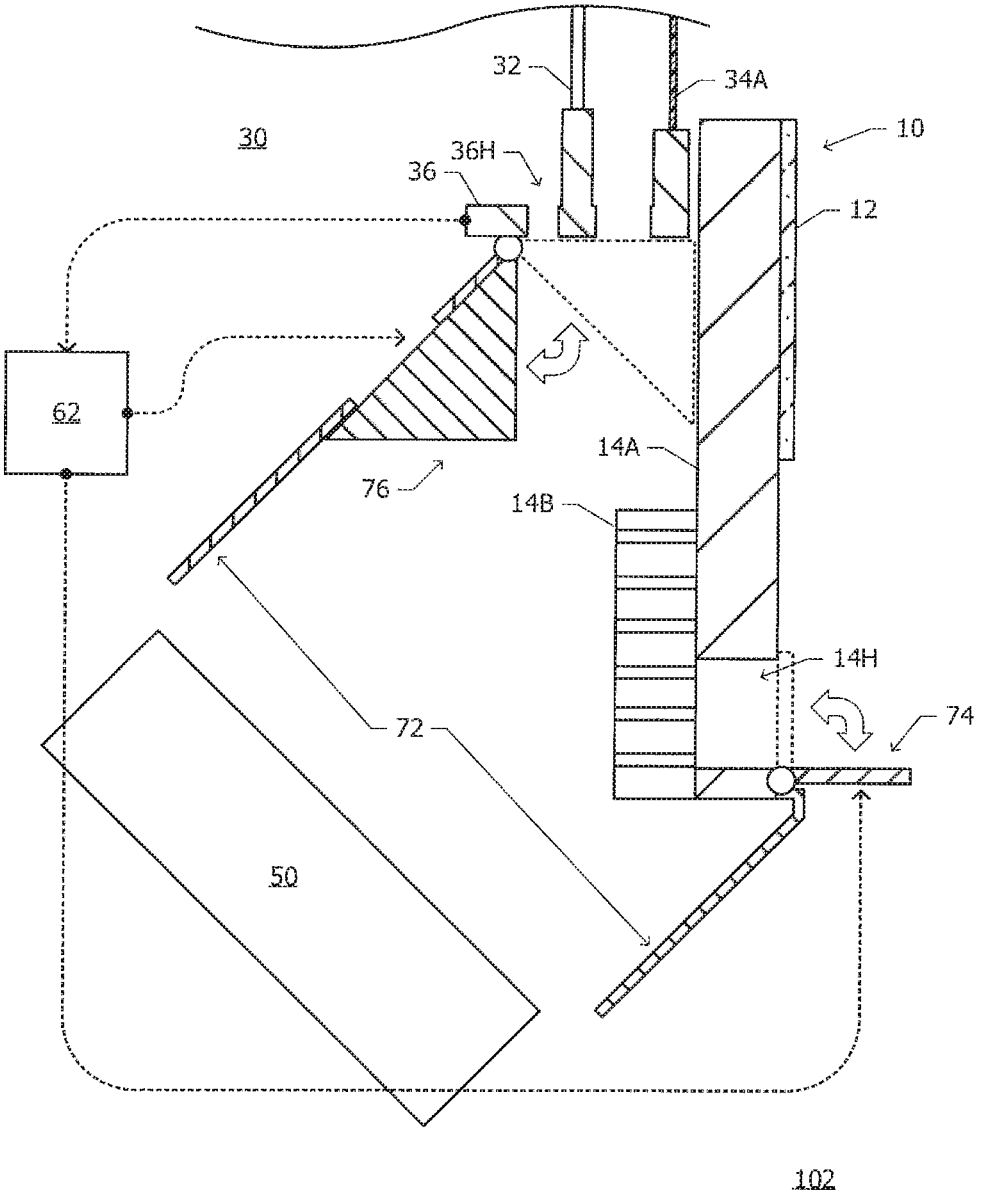
FIG. 2 is an enlarged cross-sectional view showing a developed aspect of the vehicular lamp according to the exemplary embodiment.

The present inventors have investigated a headlight capable of heating a light distribution control device depending on the situation. Hereafter, a description will be given of a headlight developed from a basic type of headlight. With reference to FIG. 2, the structure of respective components added to the headlight of the basic type will be mainly described, and the function of the components will be mainly described with reference to FIGS. 3 and 4.

FIG. 2 is an enlarged cross-sectional view of a headlight development 102 according to an embodiment in a developed aspect. The headlight 102 has a structure in which a ventilation pipe (duct mechanism) 72, a first damper mechanism 74, and a second damper mechanism 76 are further provided in a headlight 100 (see FIG. 1) of a basic type. For the sake of convenience, the illustration of components unnecessary for the description of the various mechanisms 72, 74, and 76 is omitted.

The ventilation pipe 72 has, for example, a cylindrical shape, and is disposed so that the light source 10 (in particular, the fin portion 14B) and the light distribution control device 30 (in particular, in the vicinity of the liquid crystal element 32 and the input-side polarizing plate 34A) are accommodated in one open end, and the blower fan 50 is accommodated in the other open end. The provision of the ventilation pipe 72 can effectively sent the airflow (wind) generated by the blower fan 50 to the light source 10 (in particular, the fin portion 14B) and the light distribution control device 30 (in particular, in the vicinity of the liquid crystal element 32 and the input-side polarizing plate 34A).

The first damper mechanism 74 is attached to the ventilation pipe 72, and together with a ventilation hole 14H (defined as a "through hole" in claim) provided in the base portion 14A of the heat sink 14, constitutes an airflow control mechanism. The first damper mechanism 74 may be attached to the base portion 14A of the heat sink 14.

The first damper mechanism 74 can control the flow of air (flow direction) through the ventilation hole 14H of the heat sink depending on its open/closed condition. That is, the airflow passing through the ventilation hole 14H is discharged to the outside of the ventilation pipe 72 in the opened state (the state shown by the solid line and the oblique line pattern), and the airflow passing through the ventilation hole 14H is stagnated in the closed state (the state shown by the broken line). Specifically, as the first damper mechanism 74 as the airflow control mechanism is disposed to be capable of closing the ventilation hole 14H (through hole) provided to the base portion 14A of the heat sink 14, it can function to shield the airflow to be passed through the ventilation hole 14H (through hole).

The second damper mechanism 76 is attached to, for example, the ventilation pipe 72, and forms the airflow control mechanism together with the ventilation hole 36H provided in the housing 36 of the light distribution control mechanism 30. In addition, it also serves as a heat transfer control mechanism configured to conduct heat from the light source 10 to the light distribution control device 30.

The damper mechanism 76 can control the flow of air (flow direction) through the housing 36 of the light distribution controller 30 according to its open/closed condition. That is, the airflow from the blower fan is allowed to be passed through the housing 36 in the opened state (the state shown by the solid line and the hatched line pattern), and the airflow blown into the housing 36 is shielded in the closed state (the state shown by the broken line).

Further, the damper mechanism 76 may control the thermal conduction from the light source 10 (particularly the base portion 14A of the heat sink) to the light distribution control device 30 (particularly the housing 36 or the liquid crystal element 32 and the input side polarizing plate 34A via the housing 36) according to its open/closed condition. That is, the base portion 14A and the housing 36 are thermally connected in the closed state (the state shown by the broken line), and the base portion 14A and the housing 36 are thermally separated in the opened state (the state shown by the solid line and the hatched pattern). This means that the thermal connection control between the light source and the light distribution control device is achieved for thermal conduction control of heat between the light source and the light distribution control device.

Further there may be provided a control element 62 configured to control the opening and closing states of the first and second damper mechanisms 74 and 76 while monitoring the temperature of the light distribution control device 30, e.g., the housing 36, and the ambient air temperature. Note that the control element 62 is not necessarily provided, and the control by the control element 62 may be performed by the control device 60 (see FIG. 1).

Figure 3:
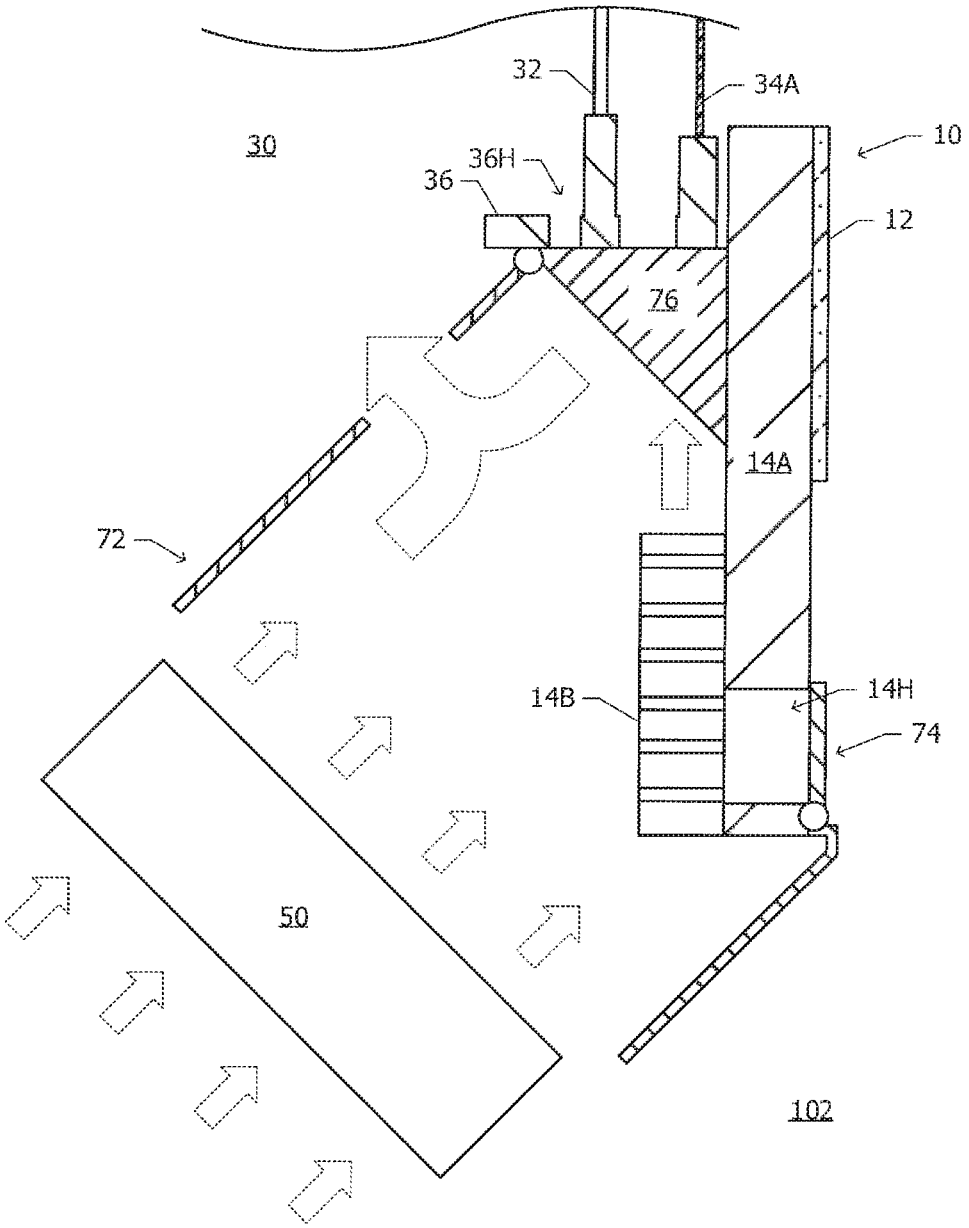
FIG. 3 is an enlarged cross-sectional view showing one aspect of the vehicular lamp in the developed aspect.

FIG. 3 shows both the first and second damper mechanisms 74 and 76 in the closed state. The temperature of the light source 10 (LED element) rapidly reaches a high temperature immediately after the light source 10 is turned on. On the other hand, the temperature of the liquid crystal element 32 rises at a slower rate than that of the light source 10. In a low-temperature environment (for example, 0° C. or lower), the response speed of the liquid crystal element 32 is remarkably lowered, and therefore, the liquid crystal element 32 is preferably heated (warmed).

When the second damper mechanism 76 is closed to thermally connect the base portion 14A of the light source 10 and the housing 36 of the light distribution control device 30, heat generated in the LED element is conducted to the liquid crystal element 32 via the housing 36, so that the liquid crystal element 32 is heated. As a result, the response speed of the liquid crystal element 32 can be increased in a low temperature environment.

Note that when the first damper mechanism 74 is also closed, the air warmed by the heat discharged from the fin portion 14B is not exhausted to the outside of the ventilation pipe 72 but remains inside the ventilation pipe 72 or flows in the direction toward the light distribution control device 30 (the second damper mechanism 76). As a result, the light distribution control device 30 in the vicinity of the liquid crystal element 32 is heated more effectively, and so the response speed of the liquid crystal element 32 can be increased.

Figure 4:
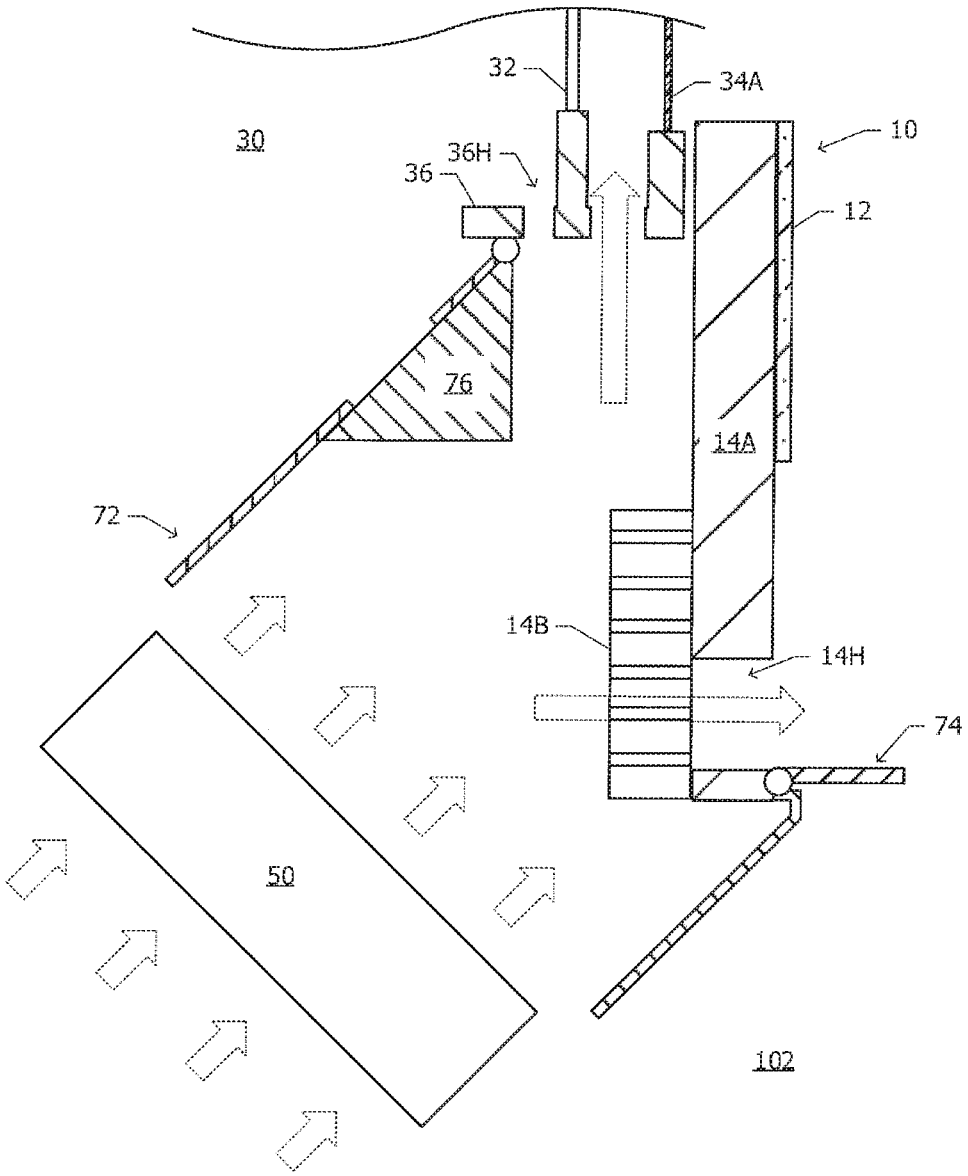
FIG. 4 is an enlarged cross-sectional view showing another aspect of the vehicular lamp in the developed aspect.

FIG. 4 shows both the first and second damper mechanisms 74 and 76 in the opened state. When a predetermined time elapses after the light source 10 (LED element) has been turned on, the input-side polarizing plate 34A and the liquid crystal element 32 also reach a high temperature. At this time, the second damper mechanism 76 is opened, so that the base portion 14A of the light source 10 and the housing 36 of the light distribution control device 30 are thermally separated from each other.

When the second damper mechanism 76 is opened, the air sent from the blower fan 50 directly hits the liquid crystal element 32, the pair of polarizing plates 34, and the housing 36. This configuration can achieve cooling of the light distribution control device 30, in particular, the liquid crystal element 32 and the input-side polarizing plate 34A.

When the first damper mechanism 74 is opened, the air warmed by the heat discharged from the fin portion 14B is exhausted to the outside of the ventilation pipe 72. Therefore, it is less likely to warm the light distribution control device 30 is by the warmed air.

As described above, the provision of the first and second damper mechanisms 74 and 76 can achieve heating (warming) of the light distribution control device 30 as necessary. The area of the second damper mechanism 76 that is in contact with the base portion 14A and the housing 36 is preferably as large as possible. The increased area can allow more efficient transmission of heat generated by the light source 10 to the light distribution control device 30.

The combination of the opened and closed states of the first and second damper mechanisms 74 and 76 is not limited to the combination described above, and may include a combination in which the first damper mechanism 74 is closed and the second damper mechanism 76 is opened, and a combination in which the first damper mechanism 74 is opened and the second damper mechanism 76 is closed. This would allow for finer temperature adjustments for the light source 10 and the light distribution control device 30.

Figure 5:
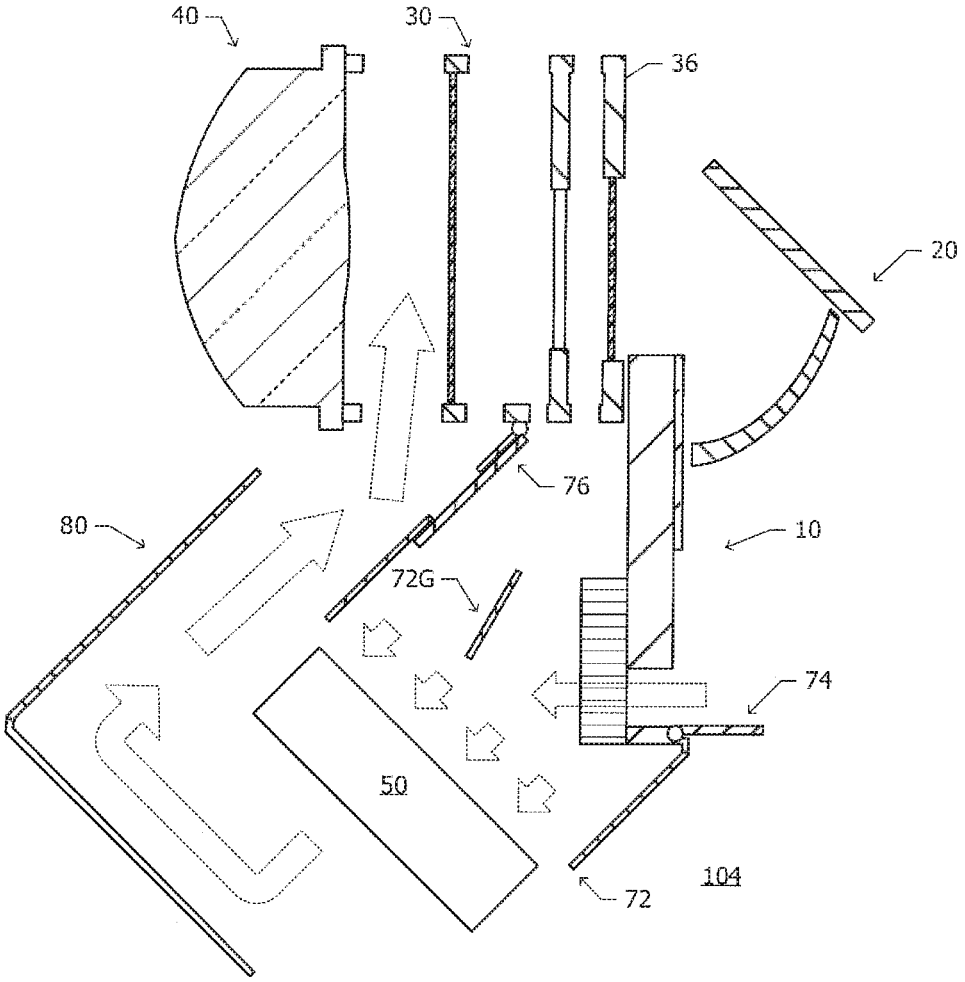
FIG. 5 is a cross-sectional view showing a modification of the vehicular lamp according to the exemplary embodiment.

FIG. 5 is a cross-sectional view showing a modification of a headlight 104 according to the embodiment. In this modification, for example, the ventilation pipe 72 may include a partition guide 72G configured to separate the air blown to the light source 10 and the light distribution control device 30 by the blower fan 50. In addition, the first and second damper mechanisms 74 and 76 may also be adjusted in terms of arrangement position, shape, structure, and the like so that the air blown by the blower fan 50 circulates satisfactorily in accordance with the arrangement positions, shapes, structures, and the like of the light source 10 and the light distribution control device 30.

Further, the blower fan 50 may be set so as to generate an airflow while the light source 10 and the light distribution control device 30 are disposed downwind of the blower fan, and blow air to the light source 10 and the light distribution control device 30. Alternatively, the blower fan 50 may be set so as to generate an airflow while the light source 10 and the light distribution control device 30 are disposed upwind of the blower fan to suck and discharge the air in the vicinity of the light source 10 and the light distribution control device 30 to the outside of the ventilation pipe 72. The direction of the blowing air and airflow can be adjusted by changing the rotation direction (right rotation/left rotation) of the blower fan 50.

When the air warmed by the heat generated by the light source 10 is exhausted to the outside of the ventilation pipe 72, the warmed air may be blown to the light distribution control device 30 to heat (warm) the light distribution control device 30. In this case, for example, an airflow guiding mechanism 80 may be provided to guide the hot air discharged to the outside of the ventilation pipe 72 to the light distribution control device 30. The airflow guiding mechanism 80 may use, for example, a general duct or an extension mechanism commonly used in vehicular lamps as an extension. At this time, it is preferable that both of the first and second damper mechanisms 74 and 76 be in the opened state.

While the presently disclosed subject matter has been described above on the basis of the exemplary embodiments, the presently disclosed subject matter is not limited thereto. For example, in the light distribution control device, a housing may not be provided. However, when it is desired to effectively cool a liquid crystal element or a pair of polarizing plates which can be heated to become a high temperature, a housing having a high thermal conductivity and an excellent heat dissipation property may preferably be provided.

The first and second damper mechanisms 74 and 76 may not be attached to the ventilation pipe 72, but may be independent mechanisms. All of the various mechanisms 72, 74, and 76 may not be provided simultaneously, and any of them may be provided. In addition, the second damper mechanism may include a portion having an airflow control function and a portion having a heat transfer control function as separate mechanisms. It will be apparent to those skilled in the art that various modifications, improvements, combinations, and the like are possible.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicular lamp comprising:

a light source configured to emit light along an optical path;

a light distribution control device disposed on the optical path of the light emitted from the light source; and a blower fan configured to generate an airflow while the light source and the light distribution control device are disposed downwind of the blower fan, and blow air to the light source and the light distribution control device, wherein the light distribution control device includes:

a liquid crystal element disposed on the optical path of the light emitted from the light source;

a pair of polarizing plates sandwiching the liquid crystal element on the optical path; and a housing configured to support the liquid crystal element and the pair of polarizing plates and having a high thermal conductivity to dissipate heat generated by the liquid crystal element and the pair of polarizing plates, the vehicular lamp further comprises a heat transfer control mechanism configured to control thermal connection with the light source and the light distribution control device to control conduction of heat generated by the light source to the light distribution control device, the light source includes a semiconductor light-emitting element, and a heat sink including a base portion on which the semiconductor light-emitting element is mounted the heat transfer control mechanism includes a movable member configured to switch a thermal conduction state between the base portion and the housing so that the base portion and the housing are thermally connected or not, and the movable member is controlled to be in a first position so that heat generated in the semiconductor light-emitting element is conducted to the liquid crystal element, or to be in a second position so that air sent from the blower fan directly hits the liquid crystal element and at least one of the polarizing plates.

2. The vehicular lamp according to claim 1, wherein the heat transfer control mechanism is disposed between the blower fan and the light distribution control device and also configured to shield an airflow from the blower fan to the light distribution control devices, and when the heat transfer control mechanism is located in the first position, the heat transfer control mechanism shields air blown from the blower fan in between the liquid crystal element and the at least one of the polarizing plates.

3. The vehicular lamp according to claim 1, wherein the heat sink is configured to efficiently dissipate heat generated by the semiconductor light-emitting element and have the base portion having a plate shape provided with a through hole.

4. The vehicular lamp according to claim 2, wherein the heat sink is configured to efficiently dissipate heat generated by the semiconductor light-emitting element and have the base portion having a plate shape provided with a through hole.

5. The vehicular lamp according to claim 1, wherein the blower fan is configured to generate an airflow while the light source and the light distribution control device are disposed upwind of the blower fan to cause the air warmed by heat generated by the light source to move in a direction away from the light source and the light distribution control device.

6. The vehicular lamp according to claim 1, wherein the movable member is in direct contact with the base portion and the housing.

7. The vehicular lamp according to claim 1, serving as a headlight.

8. A vehicular lamp comprising:

a light source configured to emit light along an optical path;

a light distribution control device disposed on the optical path of the light emitted from the light source; and a blower fan configured to generate an airflow while the light source and the light distribution control device are disposed downwind of the blower fan, and blow air to the light source and the light distribution control device, wherein the light source includes a semiconductor light-emitting element, and a heat sink configured to efficiently dissipate heat generated by the semiconductor light-emitting element and having a base portion having a plate shape provided with a through hole, and the vehicular lamp further comprises an airflow control mechanism that is disposed to be capable of closing the through hole provided to the base portion of the heat sink and configured to shield an airflow to be passed through the through hole.

9. The vehicular lamp according to claim 8, wherein the light distribution control device includes:

a liquid crystal element disposed on the optical path of the light emitted from the light source;

a pair of polarizing plates sandwiching the liquid crystal element on the optical path; and a housing configured to support the liquid crystal element and the pair of polarizing plates and having a high thermal conductivity to dissipate heat generated by the liquid crystal element and the pair of polarizing plates.

10. The vehicular lamp according to claim 8, further comprising a heat transfer control mechanism configured to control thermal connection with the light source and the light distribution control device to control conduction of heat generated by the light source to the light distribution control device.

11. The vehicular lamp according to claim 8 wherein the fight distribution control device includes:

a liquid crystal element disposed on the optical path of the light emitted from the light source;

a pair of polarizing plates sandwiching the liquid crystal element on the optical path; and a housing configured to support the liquid crystal element and the pair of polarizing plates and having a high thermal conductivity to dissipate heat generated by the liquid crystal element and the pair of polarizing plates, the vehicular lamp further comprises a heat transfer control mechanism configured to control thermal connection with the light source and the light distribution control device to control conduction of heat generated by the light source to the light distribution control device.

12. The vehicular lamp according to claim 10, wherein the heat transfer control mechanism is disposed between the blower fan and the light distribution control device and also configured to shield an airflow from the blower fan to the light distribution control device.

13. The vehicular lamp according to claim 11, wherein the heat transfer control mechanism is disposed between the blower fan and the light distribution control device and also configured to shield an airflow from the blower fan to the light distribution control device.

14. The vehicular lamp according to claim 8, wherein the blower fan is configured to generate an airflow while the light source and the light distribution control device are disposed upwind of the blower fan to cause the air warmed by heat generated by the light source to move in a direction away from the light source and the light distribution control device.

15. The vehicular lamp according to claim 11, wherein the light source includes a semiconductor light-emitting element and a heat sink including a base portion on which the semiconductor light-emitting element is mounted, the heat transfer control mechanism includes a movable member configured to switch a thermal conduction state between the base portion and the housing so that the base portion and the housing are thermally connected or not, and the movable member is controlled to be in a first position so that heat generated in the semiconductor light-emitting element is conducted to the liquid crystal element, or to be in a second position so that air sent from the blower fan directly hits the liquid crystal element and at least one of the polarizing plates.

16. The vehicular lamp according to claim 8, serving as a headlight.

* * * * *